United States Patent [19]

Watkins

[11] Patent Number: 4,842,441

[45] Date of Patent: Jun. 27, 1989

[54] APPARATUS FOR FILLING A TRENCH IN A PAVED SURFACE

[75] Inventor: Lester Watkins, Phoenix, Ariz.

[73] Assignees: Mable M. Watkins, Phoenix; Ella N. Norman, Casa Grande, both of Ariz.

[21] Appl. No.: 63,649

[22] Filed: Jun. 18, 1987

Related U.S. Application Data

[63] Continuation of Ser. No. 827,557, Feb. 10, 1987, abandoned.

[51] Int. Cl.[4] ..... E01C 19/50

[52] U.S. Cl. ..... 404/98; 404/107

[58] Field of Search ..... 404/98, 101, 104, 105, 404/107, 108, 110, 72, 75

[56] References Cited

U.S. PATENT DOCUMENTS

| | | | |
|---|---|---|---|
| 2,902,910 | 9/1959 | Malsbury et al. | 404/105 |
| 3,304,845 | 2/1967 | Mentes | 404/101 |
| 3,518,924 | 7/1970 | Gray | 404/75 |
| 3,909,146 | 9/1975 | Hoffman | 404/110 |
| 4,101,237 | 7/1978 | Catenucci | 404/98 |
| 4,507,012 | 3/1985 | Corcoran et al. | 404/72 |

FOREIGN PATENT DOCUMENTS

| | | | |
|---|---|---|---|
| 2436850 | 5/1980 | France | 404/98 |

*Primary Examiner*—Jerome W. Massie, IV
*Assistant Examiner*—Matthew Smith
*Attorney, Agent, or Firm*—Charles E. Cates

[57] ABSTRACT

The improvement to machines for filling trenches in paved surfaces has two hoppers hydraulically operated to deposit selected course material directly into the trench from a substantially vertical drop in substantially equal quantities from each side. At least one of the hoppers moves responsive to the movement of guide rails that follow the contours of the trench. A vertically adjustable strike-off plate, adapted to define a course level above or below the level of the surrounding paved surface, has two components, at least one of which moves relative the other responsive to the guide rails to accommodate trench width, and includes apparatus for laying down a window of paving material during a final pass and pushing it into a mini-trench created by intrusion of the guide rails.

13 Claims, 4 Drawing Sheets

APPARATUS FOR FILLING A TRENCH IN A PAVED SURFACE

CROSS-REFERENCE TO RELATED APPLICATION

This application is a continuation of co-pending U.S. Pat. application Ser. No. 827,557, filed Feb. 10, 1987, and entitled "Apparatus and Method For Filling a Trench In a Paved Surface" by Lester Watkins now abandoned.

FIELD OF THE INVENTION

This invention relates to improvements in apparatus for filling utility trenches in paved surfaces, with particular reference to machines and methods for replacing material in flexible pavement structures.

BACKGROUND OF THE INVENTION

The paving and spreading machines in general use are designed for only narrow utilization; i.e., to process pavement structures six or more feet in width, during which only leveling and thickness control is achieved. No provision in such machines is made for backfilling a pavement structure to a specified thickness lift of imported material in small trenches cut for emplacing or repairing utility installations. Therefore, when it is necessary to fill and pave such small trenches, an inferior procedure has been followed in which base material is trucked in, dumped in piles alongside an open utility trench and, subsequently, pushed into the trench by a loader or a grader, or hand shoveled into the trench. As a result, (a) segregation of material takes place, (b) the material is not compacted to maximum density due to the cooling of asphalt cement, (c) the pavement is not laid down to specified, uniform thickness, (d) problematical cold joints at the sides and ends of the trench are encountered and (e) the entire operation is inefficient and wasteful of materials.

OBJECTS OF THE INVENTION

It is therefore a broad object of my invention to provide an improved apparatus and method for backfilling and completing, with imported material, relatively small trenches cut in a flexible pavement structure.

It is a more specific object of my invention to provide such apparatus and method by means of which: a utility trench may be uniformly backfilled to a first level below the surrounding pavement surface with a first material and may thereafter be finished with asphalt or other finish material deposited in a uniform layer which has an upper surface above the surface of the surrounding pavement such that it may subsequently be rolled to the pavement level to complete the operation.

SUMMARY OF THE INVENTION

These and other objects of my invention are achieved by an apparatus for filling trenches, cut in a pavement structure, with predetermined imported materials and to predetermined levels appropriate for each prescribed course, with particular reference to flexible pavement structures. The apparatus includes: (1) an application mechanism for depositing the specified course material in the trench to a desired level below or above the finish grade; (2) a feeding mechanism for supplying specified course material to the application mechanism, the feeding mechanism including two hoppers respectively disposed on the two sides of the application mechanism, transverse the trench, which hoppers are adapted to receive the imported course material from a suitable external source of supply as needed, and (3) a dispensing mechanism for transferring the course material from each hopper in substantially the same quantities directly into the trench in a direction perpendicular to the base of the trench.

The application mechanism constitutes a combination of: guide rails bearing against the sides of the trench in conjunction with structure causing the guide rails to be movably biased against the trench sides; and a strike-off gate (having a plurality of cooperating gate sections) that extends across the trench between the rails, one of which gate sections is movable in response to lateral movement of the guide rails relative each other. The gate sections are adapted to overlap on their flat sides and move relative to each other to accommodate changes in the width of the trench as sensed by the guide rails.

The dispensing mechanism conveniently may include a pair of cooperating hydraulic rams adapted to raise the outboard sides of the two hoppers (which are preferably pivotally hinged at their inboard sides to appropriate parts of the frame) in unison. A signal from an operator, either human or machine, causes a controlled lift of the hoppers to tip them toward the trench and cause the course material to fall from both sides in approximately equal quantities directly into the trench in a substantially vertical direction.

A first guide rail may be fixed relative the frame of the apparatus whereas a second guide rail is movably carried relative the frame by structure for reciprocatingly moving the second guide rail across the trench relative to the fixed guide rail. The strike-off gate sections slide across each other responsive to the relative movement of the guide rails which follow the sides of the trench as the distance between them narrows and widens.

The strike-off gate is provided with structure for adjusting the effective vertical strike-off gate position to accommodate both backfilling to a predetermined level below the surface of the surrounding pavement and laying the final paving material. This feature also accommodates variations in the quantity of the paving material so that, typically, the trench is filled to a height somewhat above the level of the surrounding pavement structure in which the trench is made. Thus, when the excess is rolled and compacted, it is made level with the surrounding paved surface.

The gate sections of the strike-off gate also include specialized structure for depositing two small windrows of paving material on the two sides of the trench as the final course of paving material is deposited. The windrows serve to fill the joints left between the paving material deposited in the trench and the edges of the adjacent existing paved surface by the intrusion of the guide rails. A herding feature, which conveniently takes the form of an adjustable plate formed and disposed so as to guide the windrows into the joints behind the passage of the guide rails, is also provided to complete the joint filling operation.

In a particularly preferred use, the apparatus is moved along the path of an excavated trench and is supported on runners which bear on the paved surface outboard the sides of the trench. The guide rails depend from the runners and bear on the inside vertical surfaces of the trench.

The feed mechanism may be supported by the runners or alternatively may be affixed to a frame on which the runners are also carried. Also, in a presently preferred embodiment, the dispensing of paving materials from the feed mechanism is controlled by hydraulic rams responsive to a human operator who actuates the apparatus by means of hydraulic signals.

The machine is intended to be coupled to and towed by a dump truck which provides motive power for moving the machine along the length of the trench while also providing a source for continuously supplying the course material to the feed system.

The imported selected material, appropriate for a given course, is discharged essentially vertically from the feed mechanism directly into the trench. The vertical fall may be controlled and directed by the sides of the application mechanism which are roughly coextensive with the width of the trench and by the strike-off gate which provides a third wall at the rear. Typically, a fourth wall is found opposite the strike-off gate, but it is not necessary that this be a solid wall.

DESCRIPTION OF THE DRAWING

The above and other features of the present invention may be more fully understood from the following detailed description taken together with the accompanying drawings wherein similar reference characters refer to similar elements throughout and in which.

DETAILED DESCRIPTION OF THE PREFERRED EMBODIMENT

Figure 1:
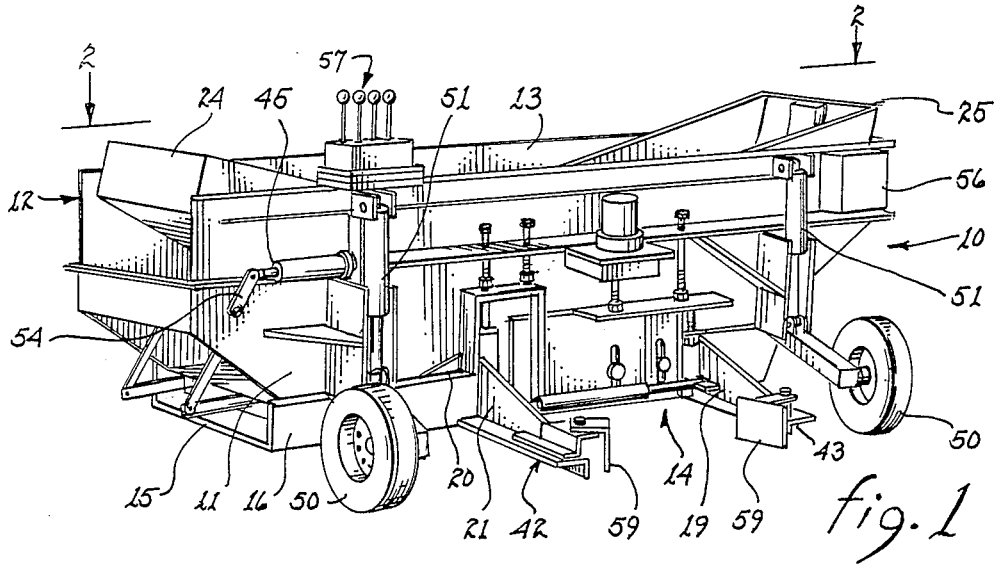
FIG. 1 is a perspective view of a rear and side elevation of the apparatus of this invention.
Figure 2:
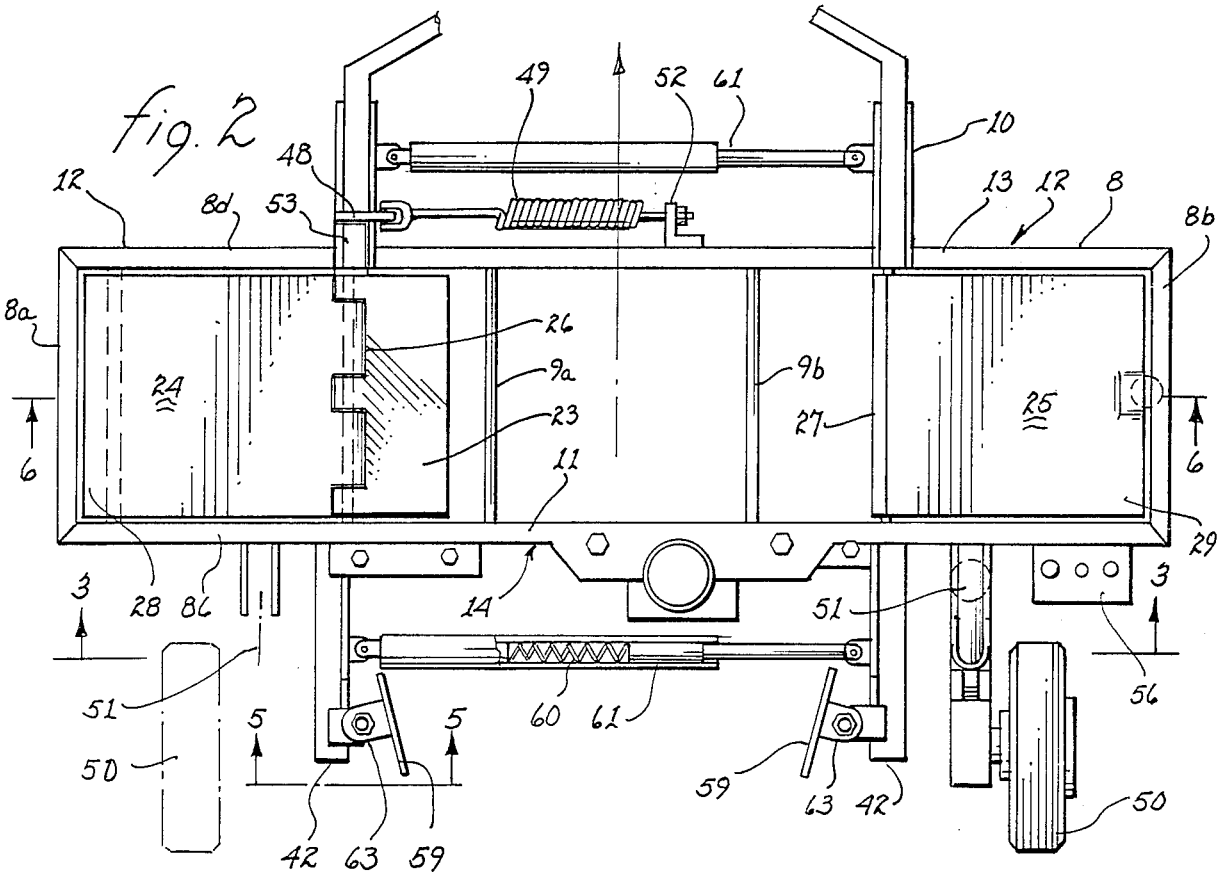
FIG. 2 is a plan view of the apparatus of FIG. 1.
Figure 3:
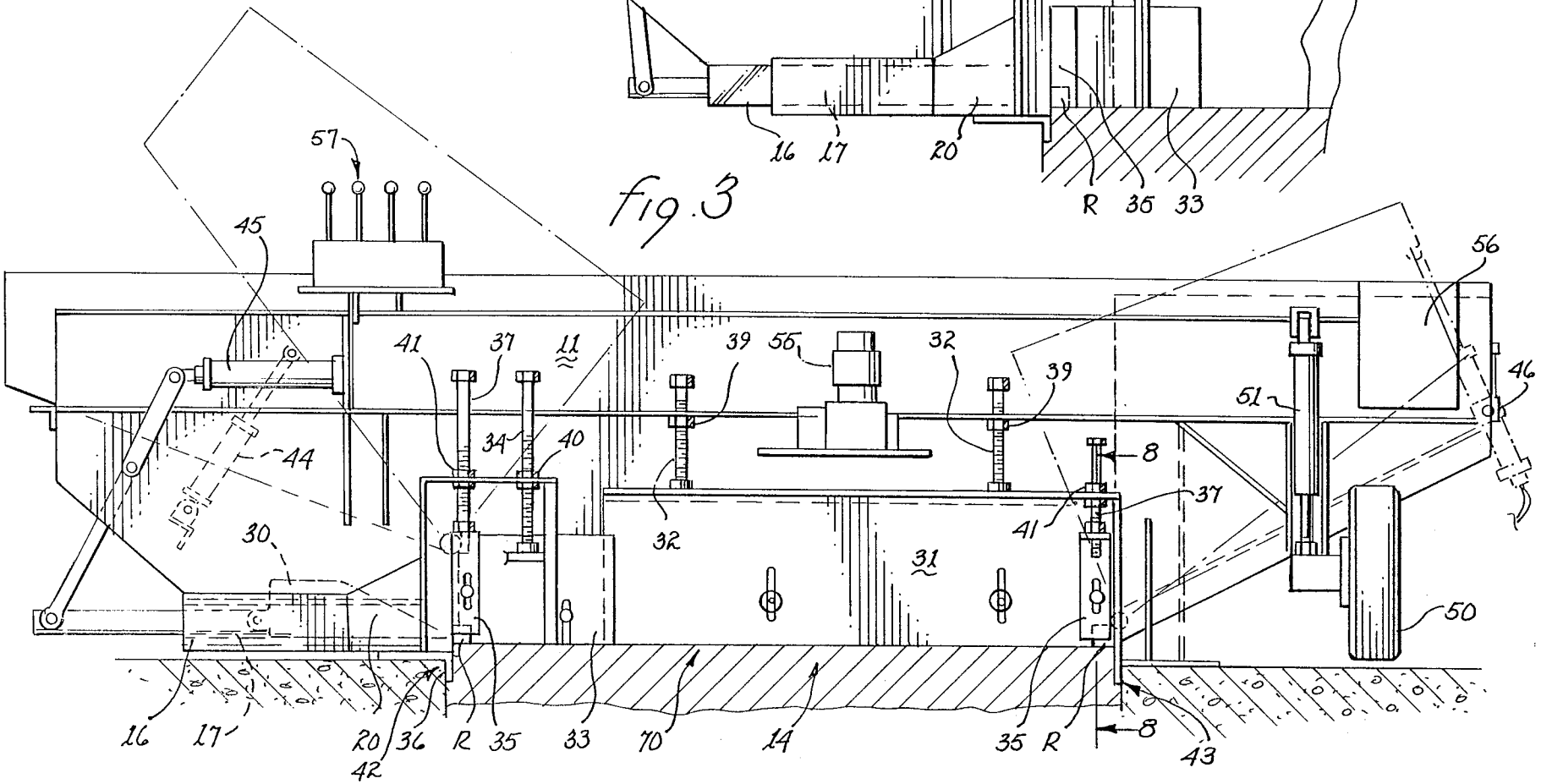
FIG. 3 is an elevation view of the apparatus shown in FIG. 2 taken along the lines 3—3.

A presently preferred embodiment of the invention is shown in the accompanying figures as a machine whose best use is in the repairing of a flexible pavement structure that has been trenched for access to understreet utilities. Referring to FIGS. 1, 2 and 3 the major elements carried on a frame, generally designated as 10, are a feed mechanism 12 and an application mechanism 14. The frame 10 includes front 11 and back 13 walls, a girdle 8 embracing four sides as 8*a*, 8*b*, 8*c*, and 8*d*, and cross braces 9*a* and 9*b*. Twin hoppers 24, 25 are pivotally hinged to the frame walls 11, 13 at 26, 27, respectively. Hydraulic rams 44, 46 serve to selectively raise the outboard ends 28, 29 of the hoppers 24, 25 in unison to feed the material carried by the hoppers into a trench at substantially equal rates from each hopper.

Figure 6:
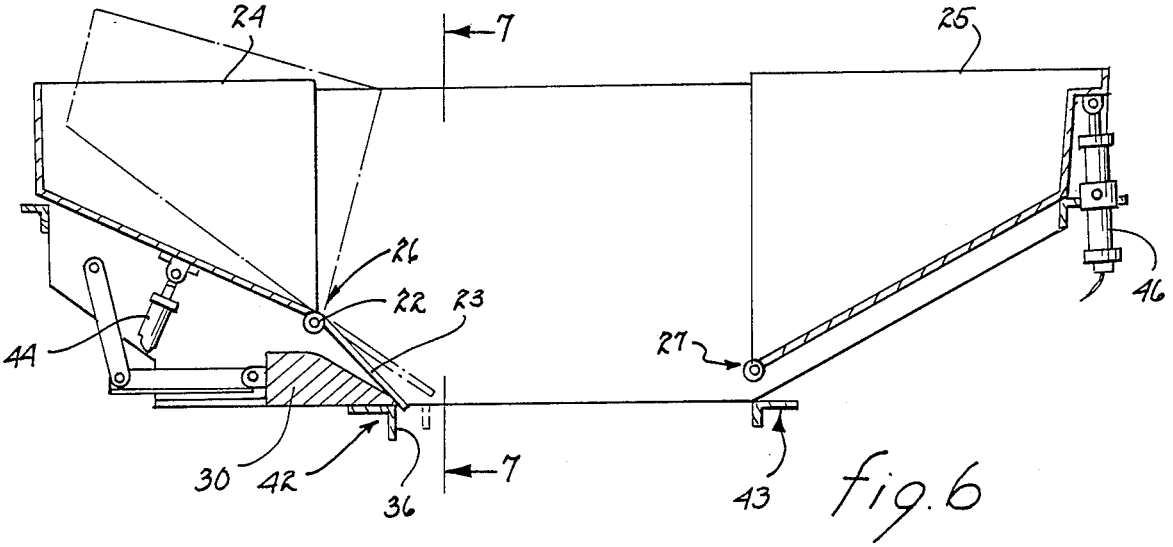
FIG. 6 is a view of the apparatus of FIG. 2, in elevation, taken in section along the lines 6—6.
Figure 7:
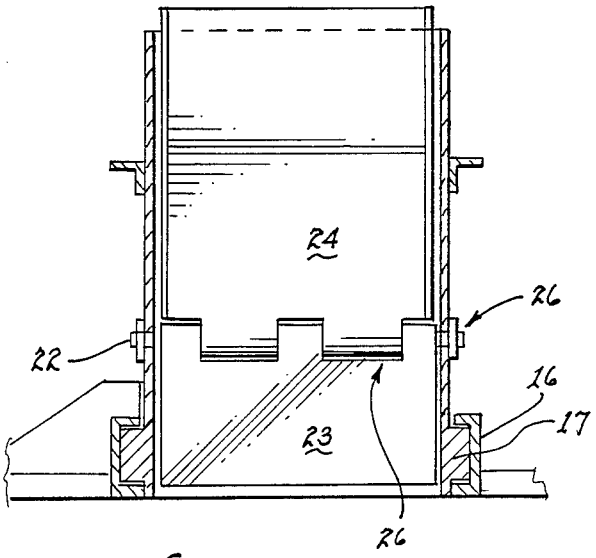
FIG. 7 is an elevation view of FIG. 6 taken in section along the lines 7—7.
Figure 8:
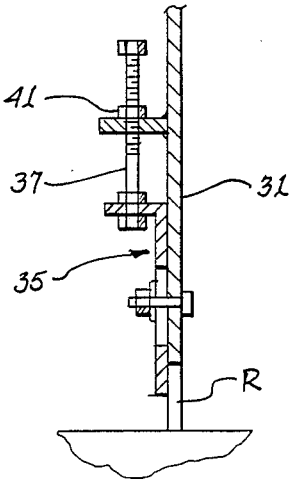
FIG. 8 is a sectional view of the windrow laying means in the apparatus of FIG. 3 taken along the lines 8—8.

Referring now to FIGS. 2, 6 and 7, a spring loaded bridge 23 is hinged to the axis 22 (supported by frame walls 11, 13) of a hinge 26 and hangs in a position to bridge the hopper 24 and a movable guide rail 42, thus preventing a loss of material to the outside of a trench. When the movable guide rail 42 moves laterally to decrease the width of the specified course when following the trench width, bridge 23 moves up following the upper contour of a box gate 30 or down when the guide rail 42 moves outwardly of the trench center, as shown in FIG. 6. The bridge 23 is spring loaded downwardly through a bell crank 48 attached to an extension 53 of the bridge 23 and responsive to the pull of a spring 49 connected to bell crank 48, all as best shown in FIG. 2.

Referring to FIG. 3, a fixed strike-off gate section 31, has been adjusted to emplace a predetermined lift thickness of imported material (such as asphalt) as determined by the setting of height adjusting screws 32, while the effective vertical position of a movable strike-off gate section 33 is correspondingly established by height adjusting screw 34. Similarly, windrow flow gates 35 are independently adjustable up and down by height adjusting screws 37. When these various adjustments have been made, the gates are secured in place by lock nuts 39, 40, 41. Together, fixed strike-off gate section 31 and movable strike-off gate section 33 form a dynamically variable width strike-off gate 70.

Referring to FIGS. 1, 3, 4, and 6, movable strike-off gate section 33, guide rail 42, box gate 30 and box gate floor 15 all move together as a unit. Elements 20, 21 are gussets which serve to strengthen the connections between wrap around ends 16 of box gate floor 15 and guide rail 42 where they join. Wrap around ends 16 of gate 30 form channels for runners 17 attached to the walls 11, 13 of frame 10 to guide in as the box floor 15 and attached elements reciprocate relative fixed guide rail 43. The latter is secured to the frame walls 11, 13 and braced by gussets 19. Thus, it will be understood that the machine components which are laterally movable as a unit with respect to a trench are supported on the runners 17 which are disposed transverse the machine and are carried by the frame 10.

Figure 5:
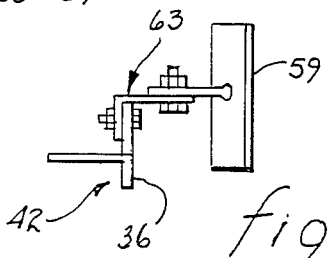
FIG. 5 is an elevation view of a portion of the apparatus shown in FIG. 2 taken along the line 5—5.
Figure 4:
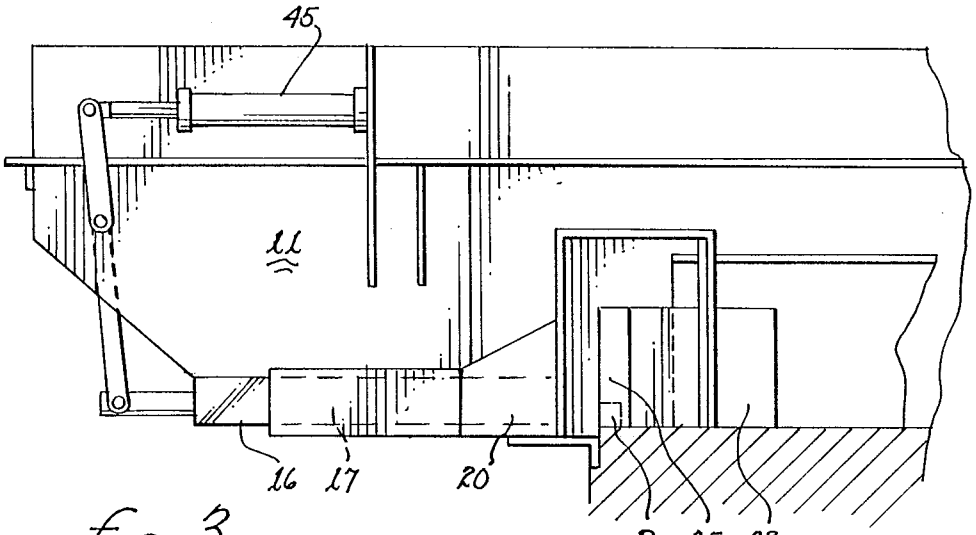
FIG. 4 is a somewhat enlarged view of the mechanism at the left side of the apparatus of FIG. 3.

Windrow flow gates 35 define the effective height of openings R provided at the outboard lower edges of strike-off gate sections 31, 33. The windrow flow gates 35 thus permit small windrows W (FIG. 9) of imported material (such as asphalt) to be laid down on each side in addition to and above that which is defined by strike-off gate 70. Referring to FIGS. 2 and 5, cutter plates 59 (connected to guide rails 42, 43 by elbows 63) follow behind, herding and placing the windrow material in the narrow joints J (FIG. 9) left by the intrusion of guide rails 42 and 43. This feature automatically fills in the joints on both sides leaving the extrusion X ready for immediate compaction. This feature meets the requirement that the joints must be filled contemporaneously with the filling of the trench; i.e., before the asphalt cools.

Figure 9:
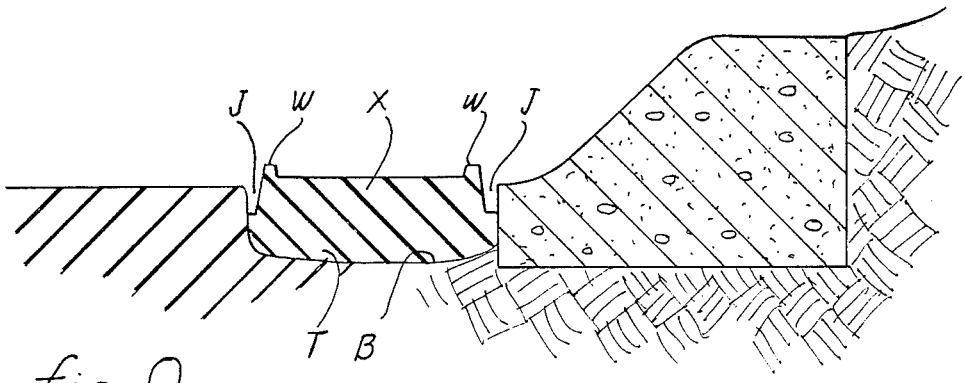
FIG. 9 is a cross section of a trench in a paved surface which has been filled with asphalt to a level slightly above the level of the surrounding paved surface, taken from a point in time just after the guide rails have passed, leaving a joint, and just before the windrows have been pushed into the joints on either side of the trench.

Still referring to FIG. 9, the operation discussed immediately above results in the deposit of an extrusion X of material, such as hot asphalt, which has an upper surface extending higher than the surface of the adjacent pavement such that a subsequent rolling operation compacts the asphalt to bring the upper surface of the extrusion to the same level as the adjacent pavement and thereby complete the job. However, for most jobs in which the subject invention finds particularly favorable use, a preliminary backfilling step must first be carried out, and the subject apparatus performs this preliminary operation efficiently and accurately.

Figure 10:
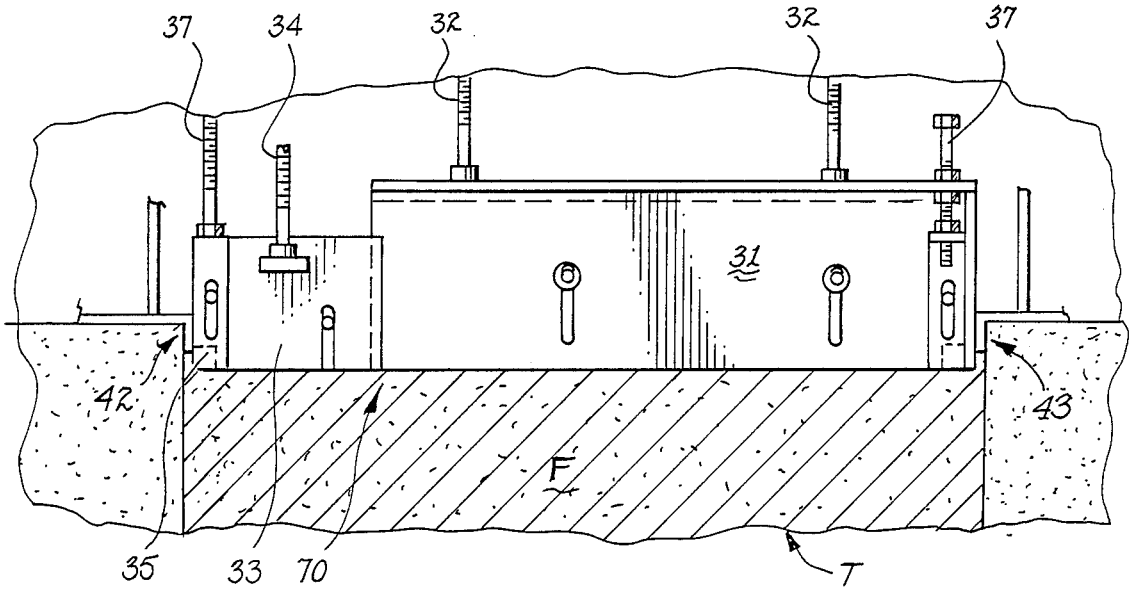
FIG. 10 is a view similar to FIG. 3, but illustrating a vertical gate component in a position appropriate to deposit backfill material to a level below the surface of the surrounding pavement.
Figure 11A:
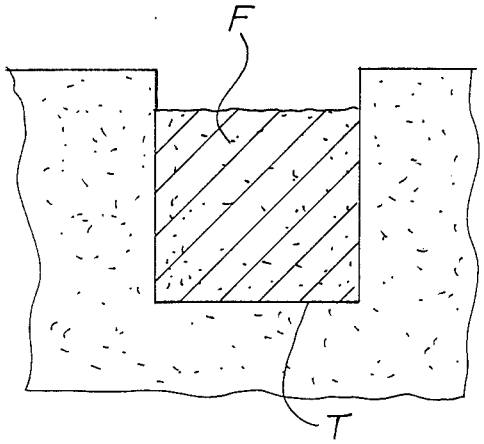
FIG. 11*a* is a cross section of a trench in a paved surface which has been partially backfilled to a level below the level of the surrounding paved surface during a first pass of the apparatus.
Figure 11B:
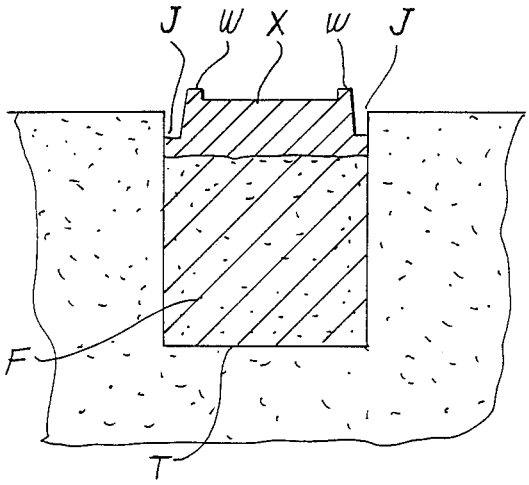
FIG. 11*b* a cross section of a trench in a paved surface after the trench has been filled with asphalt over the back fill material during a subsequent pass of the apparatus and is otherwise similar to FIG. 9.

Thus, attention is now directed to FIG. 10 and to FIGS. 11*a* and 11*b*. In FIG. 10, the strike-off gate 70 has been lowered to an effective vertical position at which its bottom edge extends a selected distance below the level of the surrounding surface and into the trench T. In addition, the windrow flow gates 35 have been lowered into a position at which their lower edges are at the same level as the lower edges of the fixed and movable strike-off gate sections 31, 33. These adjustments, as previously described, are achieved by suitably manipulating the height adjusting screws 32, 34 and 37. As a result of setting up the apparatus in the configuration illustrated in FIG. 10, imported backfill material F may be introduced into the trench from a supply placed into the hoppers 24, 25 and dispensed in the manner previously described. Because of the action of the strike-off gate 70 extending down into the trench T, the top surface of the backfill F is uniformly situated at a predetermined position, thereby insuring that a subsequent final layer of material, such as asphalt, is laid down uniformly and to specification.

Thus, as shown in FIG. 11*a*, one or more passes of the subject apparatus along the trench with the strike-off gate 70 set as shown in FIG. 10 results in a backfill F to a uniform distance below the top of the trench prior to the first of one or more lifts of finish material such as asphalt. When the extrusion X has been laid over the backfill F (FIG. 11*b*), the windrows W serving the same purpose as previously described, the extrusion is ready to be rolled. The result is a high quality and uniform completed job in which only the required quantities of materials have been used.

The various elements of the apparatus which have so far been described and discussed are mounted on the towtype frame 10 which is equipped with wheels 50 that can be raised or lowered by a hydraulic ram 51 to facilitate transportation of the machine from job-to-job. Once at the site of a given job, the wheels 50 are raised, and the machine assembly is attached (by a bridle, not shown, or in any appropriate manner) to a dump truck (not shown) which is loaded with the selected material for the specified course. As the dump truck moves forward, the machine, supported on horizontal portions of the guide rails 42, 43, is pulled along the length of the trench, and material suitable for the course is periodically fed into the hoppers 24, 25 by the dumping apparatus on the truck and, under control of the subject apparatus, is emplaced into the trench as previously described.

The machine operator has two functions to perform. The first function is to manipulate a set of hydraulic controls 57 that actuate the movable strike-off gate section 33 (along with a number of other elements, all moving as a unit) laterally (of the trench) as gate section 33 slides past the fixed strike-off gate section 31. The movable strike-off gate section 33 is positioned laterally through the action of a hydraulic ram 45 coupled to the gate section 33 by a bell crank 54 whenever the guide rails 42, 43 are placed into or removed from a trench. Upon placing the machine in position over a trench, the operator adjusts the initial width of the discharge opening 14 to fit the trench by appropriately actuating the hydraulic ram 45. The levels of the strike-off gate sections 31, 33 and windrow flow gates 35 are set to specification for the upcoming lift by adjusting the screws 32, 34 and 37 as previously described. After these adjustments have been made and operation of the machine started, the machine automatically follows any irregularities in width of the trench being filled by the operation of extension springs 60 disposed inside compression spring loaded telescoping cylinders 61 which urge the movable guide rail 42 laterally outwardly against the side of the trench which is engaged by the vertical guide member 36 of the guide rail 42.

The second operator function is to manipulate hydraulic controls 57 to actuate the left and right hydraulic rams 44, 46 to establish the instantaneous pivotal positions of the hoppers 24, 25 and thus the flow rate of the imported material selected for the prescribed course through the discharge opening into the trench as the machine is being pulled at a steady pace by the dump truck. This is undertaken in such a manner as to cause a smooth, continuous vertical flow of material to the base B and strike-off gate 70, thus preventing the undesirable segregation that occurs when the material travels horizontally over a substantial distance. The hydraulic system is conveniently powered by a 12 v d-c hydraulic pump 55 FIG. 3 energized by a suitable battery 56.

For the convenience of the reader, a tabulation of the various parts of the apparatus with the associated numerals follows:

8—Girdle
10—Frame
11—Frame Front Wall
12—Feed Mechanism
13—Frame Rear Wall
14—Application Mechanism
15—Box Gate Floor
16—Wrap Around Ends (channels)
17—Runners
19—Gusset
20—Gusset
21—Gusset
22—Axis
23—Bridge
24—Hopper (L)
25—Hopper (R)
26—Hinge (L)
27—Hinge (R)
28—Outer End of Hopper 24
29—Outer End of Hopper 25
30—Box Gate
31—Fixed Strike-off Gate Section
32—Height Adjusting Screws for Gate Section 31
33—Movable Strike-off Gate Section
34—Height Adjusting Screw for Gate Section 33
35—Windrow Flow Gates
36—Vertical Guide Member of 42
37—Height Adjusting Screws for Gates 35
39—Lock Nuts
40—Lock Nuts 41—Lock Nuts
42—Movable Guide Rail
43—Fixed Guide Rail
44—Hydraulic Ram for Hopper 24
45—Hydraulic Ram for Movable Gate Section 33
46—Hydraulic Ram for Hopper 25
48—Bell Crank
49—Spring
50—Left and Right Wheels
51—Hydraulic Rams to Raise and Lower Wheels
52—Anchor
54—Bell Crank
55—12 v d-c Hydraulic Pump
56—Battery
57—Hydraulic Controls
59—Cutter Plate
60—Internal Spring
61—External Spring Loaded Telescoping Cylinder
63—Elbow Supporting 59
70—Strike-off Gate
B—Base of T
F—Backfill Material
J—Joints
R—Openings for Establishing Windrows
T—Trench
X—Extrusion of Asphalt While the principles of the invention have now been made clear in an illustrative embodiment, there will be immediately obvious to those skilled in the art many modifications of structure, arrangements, proportions, the elements, materials and components, used in the practice of the invention, which are particularly adapted for specific environments and operating requirements without departing from those principles.

What is claimed is:

1. A machine for introducing selected course material into a trench in an existing, paved surface, said machine comprising a frame which carries:

(A) application means for depositing paving material to the trench to a desired level, said application means comprising:

1. first and second guide rails resiliently biased outwardly to bear against opposite sides of the trench and follow the contours of the trench;
2. a strike-off gate extending across the trench between said guide rails, said strike-off gate comprising;
   a. a plurality of strike-off gate sections, at least one of said gate sections being movable in response to mutual lateral movement of said guide rails, said strike-off gate sections overlapping and movable relative each other to accommodate changes in width of the trench sensed by said guide rails as they follow the contour of the trench;
   b. height adjustment means for establishing the effective vertical position of each said strike-off gate section;

(B) feed means comprising at least one hopper adapted to receive selected course material from a source of supply as needed;

(C) dispensing means for transferring the selected course material from said at least one hopper into the trench.

2. The machine of claim 1 wherein said gate sections and said guide rails move cooperatively but independently of said feed and dispensing means.

3. The machine of claim 1 in which the range of adjustment afforded by said height adjustment means includes effective vertical positions of said strike-off gate sections both above and below the level of the existing, paved surface.

4. The machine of claim 1 comprising windrow laying means for laying down windrows of paving material, when paving material is the selected course material, lengthwise of the trench; and herding means adapted to push said windrows of paving material to the side, whereby said guide rails, in passing, leave a joint at each side of the newly filled trench and said herding means fills said joints with paving material; and 5. A machine for introducing selected course material into a trench in an existing, paved surface, said machine comprising a frame which carries:

(A) application means for depositing paving material to the trench to a desired level, said application means comprising:

1. first and second guide rails resiliently biased outwardly to bear against opposite sides of the trench;
2. a strike-off gate extending across the trench between said guide rails, said strike-off gate comprising:
   a. a plurality of strike-off gate sections, at least one of said gate sections being movable in response to lateral movement of said guide rails, said strike-off gate sections overlapping and movable relative each other to accommodate changes in width of the trench;
   b. height adjustment means for establishing the effective vertical position of each said strike-off gate section; the range of adjustment afforded by said height adjustment means including effective vertical positions of said strike-off gate sections both above and below the level of the existing, paved surface.

(B) feed means comprising at least one hopper adapted to receive selected course material from a source of supply as needed;

(C) dispensing means for transferring the selected course material from said at least one hopper into the trench.

6. The machine of claim 5 wherein said feed means comprises two hoppers disposed transverse the trench on opposite sides of said application means.

7. The machine of claim 6 wherein said two hoppers are separated by a void.

8. The machine of claim 5 wherein said gate sections and said guide rails move cooperatively but independently of said feed and dispensing means.

9. The machine of claim 5 in which said first guide rail is secured on said frame and said second guide rail is carried on said frame by reciprocating movement means for accommodating variations in width across the trench and movement relative said secured guide rail.

10. The machine of claim 5 in which components thereof which are laterally movable with respect to the trench are supported on runners disposed transverse the machine and carried by said frame.

11. The machine of claim 1 in which said first guide rail is secured on said frame and said second guide rail is carried on said frame by reciprocating movement means for accommodating variations in width across the trench and movement relative said secured guide rail.

12. The machine of claim 1 in which components thereof which are laterally movable with respect to the trench are supported on runner disposed transverse the machine and carried by said frame.

13. The machine of claim 7 wherein said dispensing means comprises:

1. a cooperating pair of hydraulic rams adapted to raise the outboard sides of said hoppers; and
2. hinge means pivotally securing the inboard sides of the hoppers to said frame; whereby an operator signal causes a controlled lift of said hoppers in unison to tip the selected course material into the trench in approximately equal quantities from each of the two hoppers.

* * * * *